US010449556B2

(12) United States Patent
Mueller et al.

(10) Patent No.: US 10,449,556 B2
(45) Date of Patent: Oct. 22, 2019

(54) CENTRIFUGE HAVING A COMPRESSOR COOLING DEVICE, AND METHOD FOR CONTROLLING A COMPRESSOR COOLING DEVICE OF A CENTRIFUGE

(71) Applicant: EPPENDORF AG, Hamburg (DE)

(72) Inventors: Heiko Mueller, Panitzsch (DE); Sven Fischer, Leipzig (DE); Dieter Wolf, Bad Duerrenberg (DE)

(73) Assignee: Eppendorf AG, Hamburg (DE)

( * ) Notice: Subject to any disclaimer, the term of this patent is extended or adjusted under 35 U.S.C. 154(b) by 1094 days.

(21) Appl. No.: 14/458,361

(22) Filed: Aug. 13, 2014

(65) Prior Publication Data

US 2015/0080202 A1 Mar. 19, 2015

Related U.S. Application Data

(63) Continuation of application No. PCT/EP2013/000415, filed on Feb. 13, 2013.

(60) Provisional application No. 61/597,916, filed on Feb. 13, 2012.

(30) Foreign Application Priority Data

Feb. 13, 2012 (DE) ..... 10 2012 002 593

(51) Int. Cl.
*B04B 15/02* (2006.01)
*F25B 49/02* (2006.01)

(52) U.S. Cl.
CPC ..... *B04B 15/02* (2013.01); *F25B 49/022* (2013.01); *F25B 2400/0403* (2013.01); *F25B 2600/025* (2013.01); *F25B 2600/2513* (2013.01); *F25B 2700/21171* (2013.01); *F25B 2700/21174* (2013.01); *F25B 2700/21175* (2013.01)

(58) Field of Classification Search
CPC .. B04B 15/02; F25B 49/022; F25B 2600/025; F25B 2600/2513; F25B 2400/0403; F25B 2700/21171; F25B 2700/21175; F25B 2700/21174
USPC ..... 494/7, 14, 37
See application file for complete search history.

(56) References Cited

U.S. PATENT DOCUMENTS 4,563,879 A 1/1986 Hama et al.
4,674,292 A 6/1987 Ohya et al.
4,787,213 A 11/1988 Gras et al.
4,899,549 A * 2/1990 Berge ..... F25B 27/00 236/75
5,218,836 A 6/1993 Jarosch
(Continued)

FOREIGN PATENT DOCUMENTS

CN 1158971 A 9/1997
CN 1532472 A 9/2004
(Continued)

OTHER PUBLICATIONS

EP 0295377 Description Espacenet Machine Translation.*
EP 0344444 Description Espacenet Machine Translation.*

*Primary Examiner* — Walter D. Griffin
*Assistant Examiner* — Shuyi S. Liu
(74) *Attorney, Agent, or Firm* — Von Rohrscheidt Patents

(57) ABSTRACT

The present invention relates to a centrifuge having a compressor cooling device and it also relates to methods for controlling a compressor cooling device of a centrifuge. The centrifuge according to the invention has a controllable throttle device in the refrigeration cycle of the compressor cooling device.

20 Claims, 5 Drawing Sheets

(56) References Cited

U.S. PATENT DOCUMENTS

| | | | | |
|---|---|---|---|---|
| 2005/0066671 | A1* | 3/2005 | Srichai | B60H 1/00914 62/160 |
| 2007/0137229 | A1* | 6/2007 | Meister | F25B 5/00 62/198 |

FOREIGN PATENT DOCUMENTS

| | | | | | |
|---|---|---|---|---|---|
| CN | 201380018633 | | | 12/2014 | |
| DE | 3343516 | A1 | | 6/1985 | |
| DE | 3601817 | A1 | | 7/1987 | |
| DE | 3720085 | A1 | | 12/1988 | |
| DE | 3818584 | A1 | | 12/1989 | |
| DE | 3943336 | A1 | | 7/1990 | |
| DE | 19932721 | C1 | | 1/2001 | |
| DE | 102004041655 | | | 5/2005 | |
| EP | 0229942 | A2 | | 7/1987 | |
| EP | 0295377 | A2 | * | 12/1988 | B04B 15/02 |
| EP | 0295377 | A2 | | 12/1988 | |
| EP | 0344444 | A2 | * | 12/1989 | B04B 15/02 |
| EP | 1462740 | | * | 9/2004 | F25B 1/10 |
| EP | 1462740 | A2 | | 9/2004 | |
| EP | 1884725 | A2 | | 2/2008 | |
| EP | 1927431 | A1 | | 6/2008 | |
| GB | 2150717 | A | | 7/1985 | |
| JP | H04 366365 | | | 12/1992 | |
| JP | 2002267314 | A | | 9/2002 | |
| JP | 2003083621 | | | 3/2003 | |
| JP | 2005048988 | | | 2/2005 | |
| JP | 2007232331 | | | 9/2007 | |
| JP | 2009174800 | A | | 8/2009 | |
| JP | 2010008022 | | | 1/2010 | |
| JP | 2011255330 | A | | 12/2011 | |

* cited by examiner

CENTRIFUGE HAVING A COMPRESSOR COOLING DEVICE, AND METHOD FOR CONTROLLING A COMPRESSOR COOLING DEVICE OF A CENTRIFUGE

RELATED APPLICATIONS

This application is a continuation of PCT/EP2013/000415 filed on Feb. 13, 2013 claiming priority from German patent application DE 10 2012 002 593.9 filed on Feb. 13, 2012 and U.S. Provisional Patent Application 61/597,916 filed on Feb. 13, 2012 all of which are incorporated in their entirety by this reference.

FIELD OF THE INVENTION

The present invention relates to a centrifuge according to the preamble of claim 1 and to a method for controlling and regulating a compressor cooling device of the centrifuge according to claim 5.

BACKGROUND OF THE INVENTION

During centrifugation, in particular in very fast turning lab centrifuges heat is generated during rotation of the centrifuge rotor in the centrifuge bowl through air friction and introduction of dissipated electrical power. Since the centrifuge bowl is closed with a lid in order to prevent centrifuged material from exiting the introduced heat cannot be easily dissipated and eventually causes an increase in temperature in the material that is being centrifuged.

The temperature increase is undesirable since it can lead to destruction or uselessness of the centrifuged samples. Typically the samples have to be kept at a defined temperature, for example depending on the application at a temperature of 4° C., 22° C., or 37° C. Therefore measures were already taken in the past in order to prevent an increase of a temperature of the centrifuged material, wherein indirect cooling is typically used. For this indirect cooling the rotor is typically enclosed in the centrifuge bowl under the centrifuge cover and no cooling channel or similar is provided. Air therefore only circulates within the centrifuge bowl. Cooling is only provided through a second medium which is run along an outside of the bowl or in a wall of the bowl. Thus, typically a compressor cooling device with tubes and heat exchangers is provided through which a special refrigerant (which differs from coolants as they are run for example in cooling water cycles of cars, a refrigerant goes through phase changes when going through the refrigeration cycle, typically from liquid to gaseous and this refrigerant also facilitates temperature controlling a material to be cooled to a temperature that is below ambient temperature) is run through conduits forming the refrigerant cycle which contact the centrifuge bowl for example in spirals, this means the side wall and the base of the bowl, and run along the bowl in order to dissipate heat. A compressor cooling device of this type also facilitates cooling the sample material to a temperature below a temperature of ambient air.

Compressor cooling devices 1 include an evaporator 3 which is typically run as a conduit about the centrifuge bowl 5, a compressor 7, a condenser 9 and an expansion element 11 (c.f. FIG. 1). Thus, the expansion element 11 is configured for the highest load case, thus the maximum speed of the centrifuge rotor (not illustrated) wherein it is already known that the expansion element (which is a pressure balancing element between a high pressure side and a low pressure side of the refrigerant cycle when the compressor is stopped) is configured as a capillary tube or a thermostat injection valve 11.

In combination with pressure controlled temperature detection 13 after the evaporator 3 the thermostat controlled injection valve (TEV) 11 is used for automatically increasing or throttling a refrigerant in flow in the refrigeration cycle 15 at the evaporator inlet VE as a function of the determined temperature. Thus, super heating the refrigerant at an evaporator outlet VA is required so that a positive pressure is generated which is directly conducted onto a spring 17 of the thermostat controlled injection valve 11 in order to actuate the injection valve. Put more precisely a particular temperature is provided at the evaporator outlet VA. The sensor 13 of the TEV 11 is attached at the evaporator outlet VA, wherein refrigerant is provided at the evaporator outlet. Based on the temperature at the evaporator outlet VA the refrigerant has a respective pressure which then impacts the TEV 11 and counteracts the reset force of the spring so that the TEV 11 opens or closes.

An additional control element, for example a frequency controlled compressor 7 facilitates partially but imprecisely controlling other load cases.

Since over heating the refrigerant is required in order for the thermostat controlled injection valve 11 to function the evaporator performance cannot be used in its entirety, only approximately 95% of the evaporator surface can be used. Due to the required superheating a temperature differential of approximately 7K is provided between the evaporator inlet VE and the evaporator outlet VA.

Another essential disadvantage of such known compressor cooling devices 1 in centrifuge is that the compressors 7 can only be power controlled rather imprecisely and within certain limits, so that the compressor 7 may have to be switched off completely in various partial load cases and also low load cases.

This, however, is not possible all the time because the compressors 7 typically have a minimum run time in order to assure internal oil circulation. Vice versa due to the increased heating of the drive motor of the compressor 7 during start up and the required pressure balancing or pressure differential reduction between high pressure side and low pressure side a certain minimum shut down time is provided for such compressors 7. Therefore controllability through the compressor 7 is severely limited in particular in the low power range.

An additional disadvantage is that vibrations are generated during start up or stopping of the compressor 7 of a compressor cooling device 1. The vibrations influence operating parameters of the centrifuge, increase the remix rate in the rotor after stopping the centrifuge and impact lab equipment and similar arranged proximal to the centrifuge. Last not least, frequently turning the compressor 7 on and off reduces its service life.

BRIEF SUMMARY OF THE INVENTION

Thus, it is an object of the instant invention to overcome or mitigate these disadvantages. In particular the centrifuge with the compressor cooling device shall be configured in a simple and cost effective manner, shall have high control quality and low vibration.

The object is achieved with a centrifuge according to claim 1 and a method according to claim 5. Advantageous embodiments are provided in the dependent claims.

The centrifuge according to the invention which is in particular a laboratory centrifuge which includes a centrifuge bowl and a compressor cooling device with a refrigeration cycle, an evaporator, a compressor and a condenser and is characterized in that the refrigeration cycle includes at least one controllable throttle device for controlling a refrigerant flow which is advantageously configured as an electronic injection valve. It can be advantageously provided that the controllable throttle device also operates as a pressure balancing element between high pressure and low pressure side of the refrigeration cycle when the compressor is stopped.

A controllable, this means externally controllable throttle device, according to the present invention is a throttle device where there is a direct external control option to control refrigerant flow, thus a control link that can be influenced from outside the refrigeration cycle. Though control is also provided with a TEV 11, this, however, is not controlled from outside the refrigeration cycle 15 but by a sensor 13 which directly influences and regulates the TEV 11.

Advantageously the control option according to the invention is provided electronically, however also hydraulic and/or pneumatic control options and similar are feasible. Thermostatic injection valves however are not controllable throttle devices according to the present invention since they cannot provide direct external control but the elements passively react against a spring in response to a temperature induced pressure increase.

Since the compressor cooling device of the centrifuge includes a controllable throttle device in the cooling cycle the compressor cooling device can be directly controlled for many load cases without having to control the compressor itself. Thus, the compressor cooling device causes much less vibration and has a higher service life. Additionally it is not required any more to facilitate superheating the refrigerant and therefore the full evaporator length can be used. This increases the heat transfer surface of the evaporator which facilitates higher cooling power and improves overall efficiency of the cooling device. This helps to achieve lower cooling temperatures in the centrifuge bowl and/or the desired low cooling temperatures can also be achieved for higher centrifugation powers. Furthermore the desired temperature in the centrifuge bowl can be achieved more quickly. On the other hand side a compressor with lower power can be used even for a predetermined cooling power of the evaporator which reduces required installation space or a frequency controllable compressor can be operated at lower frequency, thus lower power, which reduces an overall energy requirement for the same cooling power. Furthermore control precision is increased which helps to achieve smaller deviations from a desired nominal value.

In an advantageous embodiment at least one device for detecting a temperature of the refrigerant in the refrigerant cycle and/or for detecting the temperature in the centrifuge bowl is provided. Advantageously a device for detecting the temperature in the centrifuge bowl, a device for detecting the temperature of the refrigerant in the refrigerant cycle upstream of the evaporator, advantageously at the evaporator inlet and a device for detecting the temperature after the evaporator is provided. Advantageously the last temperature measuring device is arranged at the evaporator outlet because otherwise the temperature may only be measured imprecisely due to overheating at a location arranged further towards the evaporator so that no optimum utilization of the evaporator may be provided. Therefore much more precise control can be facilitated.

"Devices for detecting temperature" therefore are all devices which determine a physical parameter through which a temperature can be determined. These are for example pressure or temperature sensors, wherein the temperature sensors are more cost effective and are therefore used advantageously.

Advantageously the compressor is controllable to regulate its feed volume, advantageously power controllable, in particular frequency controllable which substantially reduces a settling time for reaching a desired temperature through starting the compressor cooling device with a frequency that is increased relative to grid frequency.

Alternatively or in addition thereto a bypass can be provided in the cooling cycle for bridging the condenser, wherein the bypass is configured in particular controllable. A controllable throttle device can also be used for this regulation.

Controllable throttle devices according to the present invention can be formed as continuously controllable throttle valves and discretely controllable throttle valves.

In particular when the optional control elements are configured as continuously variable throttle device, compressor with continuously variable feed flow, continuously variable bypass valve the entire load spectrum can be covered without power surges in a very efficient and quickly responsive manner.

Regulation devices are particularly advantageous which are in particular configured as programmable electronics (e.g. micro controllers) which use at least one of the detected temperatures as an input variable and which control and regulate at least one of the elements controllable throttle device, controllable bypass and controllable compressor, because particularly effective control and regulation routines can then be used.

Independent patent protection is claimed for the method according to the invention for controlling and/or regulating the compressor cooling device of a centrifuge with a centrifuge bowl, wherein the compressor cooling device includes a refrigeration cycle, an evaporator, a compressor and a condenser and is characterized in that a controllable throttle device is used for regulating the refrigerant flow in the refrigeration cycle of the compressor cooling device. Thus advantageously the centrifuge according to the invention is used for the method.

In an advantageous embodiment a nominal temperature of the centrifuge bowl of the centrifuge is predetermined and an actual temperature of the centrifuge bowl of the centrifuge is determined. In this context advantageously a tendency of the actual temperature is determined for a predetermined tendency period in order to be able to react to temperature changes more quickly and in order to minimize deviations about the nominal value. Advantageously the tendency period is at least 2 s, advantageously at least 5 s, in particular at least 10 s. On the other hand side advantageous deviations therefrom can also be provided which are functions of size and power of the overall centrifuge system.

In an advantageous embodiment a tolerance range is defined about the predetermined nominal temperature wherein the tolerance range is +/−5 K, at the most, advantageously +/−3 K at the most and in particular +/−1.5 K. Then control can be significantly improved when the actual temperature is then only regulated by the controllable throttle device when the actual temperature is within the defined tolerance range. This regulation is particularly sensitive. "Within" the tolerance range means in this context that the temperatures at the boundaries of the tolerance range are included. Furthermore the regulation is improved when the actual temperature is only controlled through the compressor when the actual temperature is not within the tolerance range.

It is advantageously provided that a controllable compressor is used for controlling (coarse control) outside the tolerance range. When leaving the tolerance range the compressor is regulated by the actual temperature measured in the centrifuge bowl so that the actual temperature returns into the tolerance range.

Through this method of combining coarse and fine regulation (c.f. infra) the power of the compressor is used particularly advantageously and switching the compressor off and back on again in a low load range, especially also for high inner bowl temperatures is substantially prevented because the compressor is essentially only used for regulating the actual temperature until it reaches tolerance range.

Particularly advantageously the controllable throttle device is set to an empirically determined refrigerant flow when the compressor cooling device is started up and the actual temperature is lowered through the compressor down into the predetermined tolerance range. Advantageously at least at the beginning of the cooling process a position of the controllable throttle device that has been determined to be optimum for the respective centrifuge shall be used for maximum cooling and advantageously shall be subsequently adjusted to a position for optimum evaporator filling. In this context it is particularly advantageous that the compressor is only regulated for a time period until the actual temperature is within the tolerance range for an empirically determined time period, advantageously a multiple, advantageously 40 times, more advantageously 26 times and most advantageously 12 times the tendency period, for example for at least 2 minutes, after which it is in particular provided that the compressor power is kept constant and thus as long as the actual temperature is within the tolerance range and is regulated to the nominal temperature through the controllable throttle device. Thus, it is assured that only a coarse control is provided through the compressor in a first step when starting the compressor cooling device and a fine regulation is subsequently performed through the controllable throttle device at constant compressor power.

In case certain parameters are provided regarding cooling time, thus the time in which a cooling down to the nominal temperature is performed, also the power of the compressor and/or the refrigerant flow can be controlled accordingly through the controllable throttle device. However, it is also feasible to initiate fine regulation already during coarse regulation, thus simultaneously through the controllable compressor and through the controllable throttle device.

Furthermore an early cut off value above the nominal temperature or the tolerance range can be provided. Thus, the phenomenon is taken into account that a regulation process of this type causes the current actual temperature value to quickly converge towards the nominal temperature value from a positive temperature range. In order to avoid exceeding the narrow tolerance range towards negative temperatures as much as possible an early cut off value is introduced, this means before the actual nominal value which is advantageously arranged in a middle of the tolerance range is reached by the actual temperature value, the compressor is for example already regulated down or switched off or the controllable throttle device is actuated in a closing direction. This is a counter regulation against inertia of the system.

It is furthermore advantageous when the temperature of the refrigerant is determined in the refrigeration cycle on one side upstream of the evaporator, advantageously at the evaporator outlet and on the other hand side downstream of the evaporator, advantageously at the evaporator outlet and the controllable throttle device is regulated so that the difference of the temperature of the refrigerant upstream of the evaporator and the temperature of the refrigerant in the refrigeration cycle downstream of the evaporator is between 0 K and 5 K, advantageously between 0 K and 3 K, in particular between 0 K and 1 K. The recited range limits are thus permissible values. Thus, the evaporator is used in a particularly effective manner since the temperature differential of approximately 7 K required in prior solutions to provide super heat is not required any more. Simultaneously a flow through of the evaporator with liquid refrigerant and thus a liquid blockage is prevented. When a differential of greater than 0 K is regulated, it is assured that the refrigerant is completely evaporated since the positive differential is created in that a small amount of superheating is provided.

Furthermore it is particularly advantageous when the temperature of the refrigerant in the refrigeration cycle is determined upstream of the evaporator and when undercutting a predetermined temperature this predetermined temperature is at least reached again through one of the following measures: i) reducing the feed volume of the compressor, ii) opening and regulating a bypass which circumvents the condenser in the refrigeration cycle and iii) controlling the regulatable throttle device for increasing the refrigerant flow in the refrigeration cycle of the compressor cooling device. The predetermined temperature is a function of the refrigerant used and the geometric conditions between the evaporator inlet and the compressor inlet and is for example −18° C. This prevents effectively that the compressor goes into the vacuum range and the oil return fails. Therefore the throttle device has to be opened again in variant iii) when undercutting a predetermined temperature.

Alternatively or additionally the following features can be used for further reduction of vibrations of the centrifuge:

- use of a compressor with horizontal main shaft which advantageously has a low center of gravity and/or requires a large placement surface;
- use of a rotating compressor which advantageously does not require a minimum speed like a reciprocating piston compressor and/or which can be regulated downward with a frequency inverter to a standstill. Additionally, there is the advantage that the oscillating masses are omitted.
- use of an elastic support of the in particular vertically installed compressor relative to the frame of the centrifuge, wherein the support is advantageously arranged above the center of gravity of the compressor;

Independent protection is claimed regardless of the configuration of the compressor cooling device for the embodiment of a centrifuge with a compressor having features recited supra.

All features of the present invention are combinable with one another at will unless stated differently.

BRIEF DESCRIPTION OF THE DRAWINGS

The features and advantages of the instant invention are subsequently described in more detail based on an embodiment with reference to drawing figures, wherein.

DETAILED DESCRIPTION OF THE INVENTION

Figure 2:
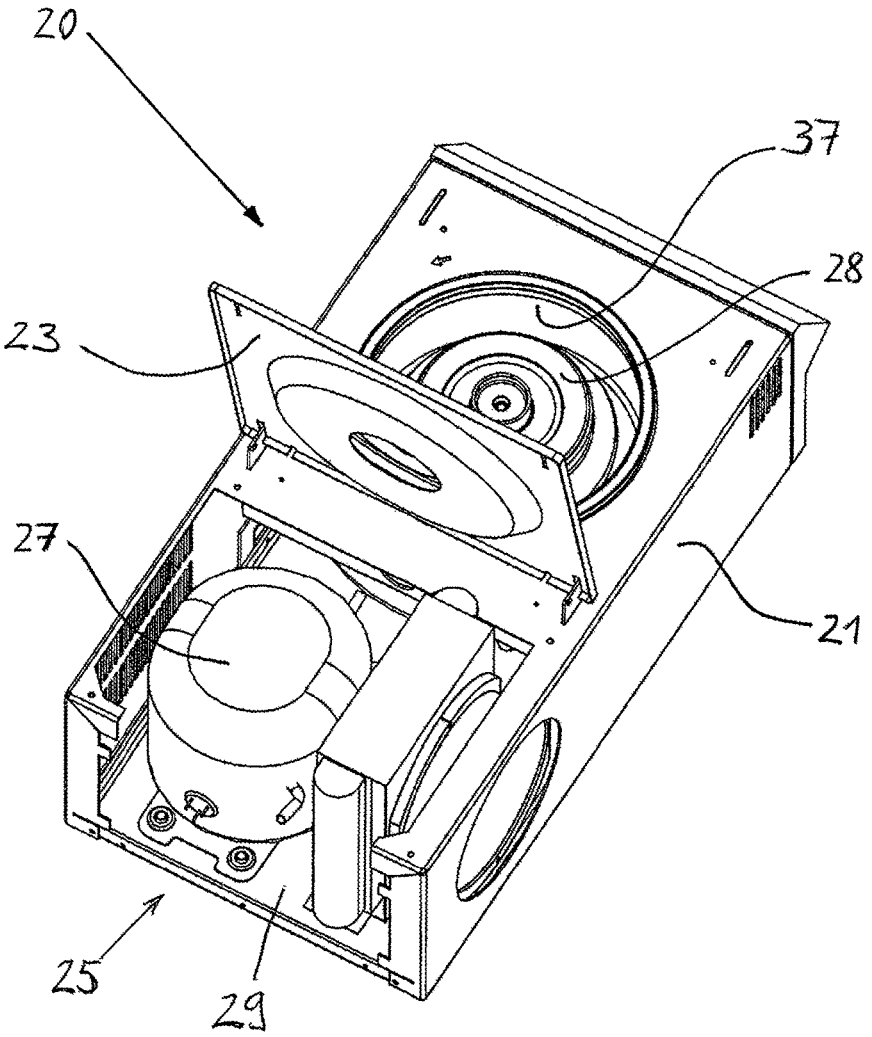
FIG. 2 illustrates the centrifuge according to the invention in a top view.

FIG. 2 schematically illustrates a perspective view of the centrifuge 20 according to the invention. The centrifuge is configured as a laboratory centrifuge 20 and includes a housing 21 with a cover (not illustrated) for the compressor cooling device 25 with the compressor 27, a lid 23 for the centrifuge bowl 37 and a rotor 28 and a base plate 29.

Figure 1:
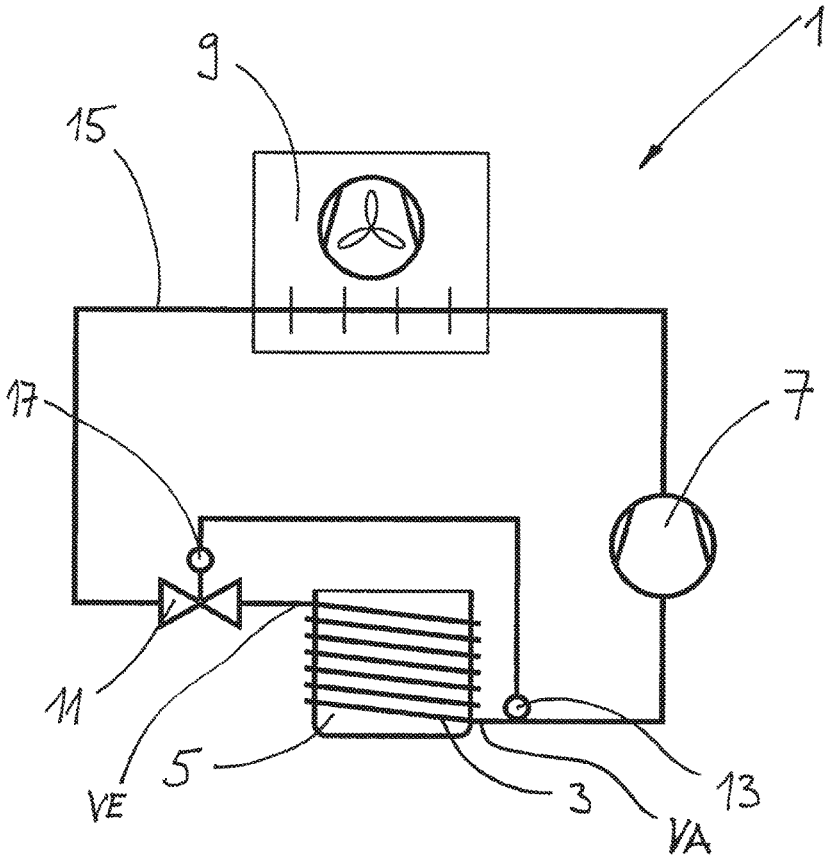
FIG. 1 PRIOR ART
FIG. 1 illustrates a block diagram of a known compressor cooling device.
Figure 3:
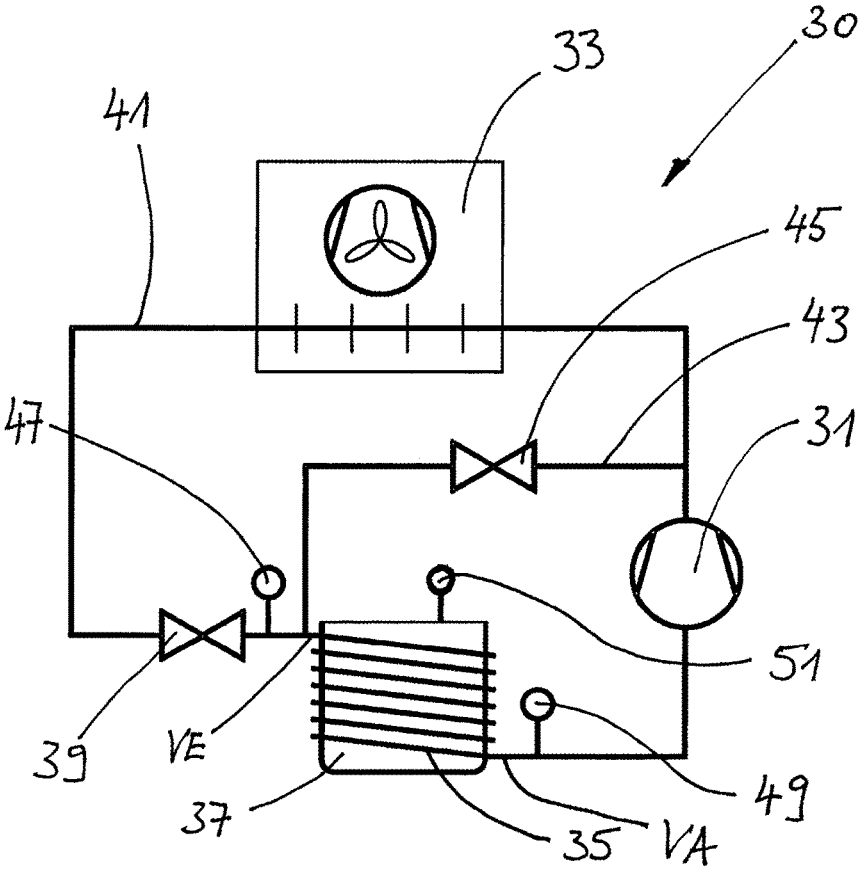
FIG. 3 illustrates the block diagram of the compressor cooling device of the centrifuge according to the invention.

FIGS. 1 and 3 illustrate differences of the compressor cooling device 30 according to the invention over a known compressor cooling device 1.

Also the compressor cooling device 30 according to the invention includes a frequency controllable compressor 31, a condenser 33, an evaporator 35 which is arranged for indirect cooling about a centrifuge bowl 37 and an expansion element 39.

The known compressor cooling device 1 illustrated in FIG. 1 includes a thermostat injection valve (TEV) configured as expansion element 11 which includes a pressure inlet 17 which is connected with a sensor 13 at an outlet VA of the evaporator 3. When reaching superheat a positive pressure is generated in the sensor 13 at the evaporator outlet VA wherein the positive pressure acts against a pressure of a spring of the TEV 11 and thus opens the TEV 11. Therefore the TEV 11 is only an element of a passive regulation since no external controllability is provided for example through electronics and it is therefore not possible to use the evaporator in its entirety due to superheat that has to be provided.

Contrary thereto the compressor cooling device 30 illustrated in FIG. 3 includes a controllable throttle device 39 configured as an electronic injection valve (EEV) 39 instead of the TEV. Furthermore the cooling cycle 41 has a bypass 43 for bridging the condenser 33. The bypass 43 is also provided with an electronic injection valve 45. Alternatively also discreet control elements can be provided instead of the continuously adjustable control elements 39, 45.

Furthermore three devices 47, 49, 51 are provided for detecting the temperature $T_{VE}$ upstream of the evaporator 35 for detecting the temperature $T_{VA}$ at the outlet VA of the evaporator 35 and for detecting the temperature T in the centrifuge bowl 37.

Figure 4:
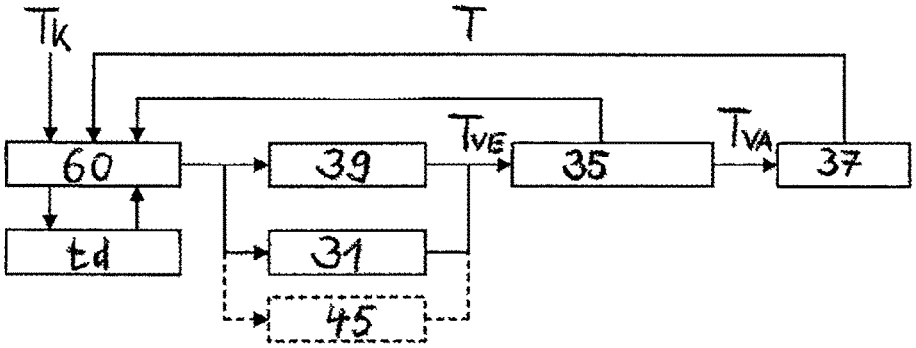
FIG. 4 illustrates the block diagram of the control according to the method according to the invention.

FIG. 4 schematically illustrates the control according to the method according to the invention.

It is evident that a regulation device 60 is used which considers the nominal temperature $T_K$ predetermined by an operator for the centrifuge bowl. At the evaporator 35 the temperature $T_{VE}$ is detected at the inlet VE and the temperature $T_{VA}$ is detected at the outlet VA and provided to the regulation device 60. Furthermore the actual temperature T is detected at the bowl 37 and provided to the regulation device 60. A tendency of the temperature development of the actual temperature T is determined for the centrifuge 20 configured according to the invention over an empirically determined tendency period td of 10 s, wherein longer and also shorter time periods are feasible. Furthermore a tolerance range of +/−1.5 K is defined for the nominal temperature $T_K$ for the centrifuge bowl 37. The regulation device 60 controls the EEV 39, the compressor 31 and optionally the bypass 45.

The control and regulation of the compressor cooling device 30 is provided as follows.

When starting the cooling device 30 of the centrifuge 20 the EEV 39 is adjusted to an empirically determined refrigerant flow and the actual temperature T is lowered down to the predetermined tolerance range through controlling the speed of the compressor 31. The speed of the compressor 31 is thus either kept at a maximum or in case a predetermined cooling time to the nominal temperature $T_K$ is desired the compressor is kept at a respective speed. Additionally an early cut off time can be used in order to consider inertia of the compressor cooling device 30 and/or the speed of the compressor 31 are lowered through an empirically determined function during coarse regulation.

Advantageously at least at the beginning of the cooling process a position of the controllable throttling device 39 that has been determined as optimum for the respective centrifuge 20 shall be used for maximum cooling and optionally updated later on into a position for optimum evaporator filling.

Coarse regulation through compressor speed is performed until the actual temperature T in the bowl 37 remains in the tolerance range for a predetermined time period (e.g. 1 min). Thus, when the actual temperature T undercuts the nominal temperature $T_K$ the power of the compressor 31 is reduced by reducing the frequency thus until the actual temperature T reaches the nominal temperature $T_K$ again or exceeds it. In case the nominal temperature $T_K$ is exceeded the frequency of the compressor 31 is increased again. This iterative process is continued until the nominal temperature T remains within the tolerance range of the nominal temperature $T_K$ for a time span of for example at least 1 min., this means for at least 6 tendency periods td.

Thereafter the compressor speed is kept constant, thus as long as the actual temperature is in the tolerance range and the nominal temperature is regulated through the controllable throttle device 39.

Thereafter it is assured that when starting the compressor cooling device 20 a first step exclusively provides coarse regulation through the compressor 31 and subsequently fine regulation through the controllable throttle device 39 at constant compressor speed is provided.

It can be provided that the controllable throttle device 39 is adjusted to a center position and the speed of the compressor 31 is adapted accordingly during coarse regulation or between coarse and fine regulation in order to be able to use the regulating ability of the throttle device 39 during fine regulation in an optimum manner. However, it is essential that no change is provided in the power of the compressor 31 during fine regulation, thus in the time period in which the actual temperature T is within the tolerance range.

During the subsequent fine regulation the cooling power is only regulated through the EEV 39 by itself. Thus, a regulation is performed according to the tendency, this means when the tendency of the actual temperature in the tendency period td decreases, the EEV 39 is regulated down, thus the refrigerant flow is reduced. In case the tendency increases the electronic injection valve 39 is regulated up so that more refrigerant is provided to the evaporator 35.

The instant invention, however, is not limited to coarse regulation (regulation through the compressor alone) and fine regulation (regulation through the throttle device alone) being performed independently from one another. It can also be provided that an overlap occurs, thus a simultaneous regulation of compressor and throttle device.

Additionally a predetermined lower limit $T_{VEmin}$ of the temperature $T_{VE}$ at an inlet VE of the evaporator 35 is monitored and when undercutting the temperature $T_{VEmin}$ the EEV 39 is opened further until the determined temperature $T_{VE}$ is greater again than the predetermined temperature $T_{VEmin}$. This prevents that the compressor 31 goes into vacuum range.

Additionally the difference of the temperature $T_{VA}-T_{VE}$ is continuously monitored. This difference should be in a range of 0 K and 1 K in order to maximize the loading to the evaporator 35 on one hand side and in order to otherwise prevent that liquid refrigerant reaches the compressor 31. In case this difference $T_{VA}-T_{VE}$ is undercut the EEV 39 is closed further and/or the compressor frequency is reduced.

The method according to the invention facilitates maximum utilization of the evaporator. Thus, the cooling power of the evaporator can be increased and in case of the centrifuge 20 according to the invention approximately 5% more heat can be dissipated compared to the known compressor cooling device which facilitates increasing the power of the rotor of the centrifuge accordingly. In the extreme a 5% increase in the heat generation through the rotor is permissible and the rotor can thus be operated in a higher speed range which increases centrifugation power.

Figure 5:
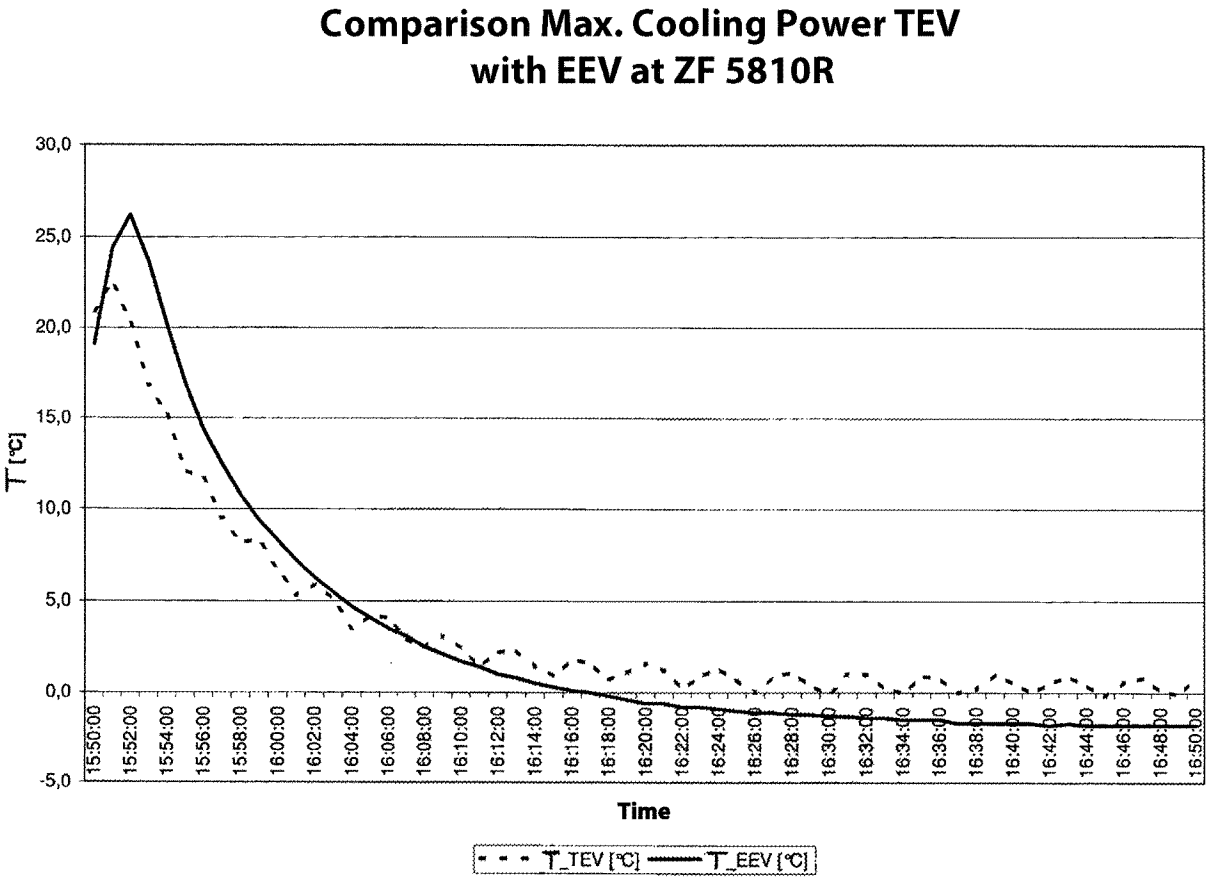
FIG. 5 illustrates a comparison of the maximum cooling power of two centrifuges, one with a known compressor cooling device with TEV and another with the compressor cooling device according to the invention with EEV.

FIG. 5 illustrates the advantageous operation of the centrifuge 20 according to the invention in combination with the method according to the invention wherein it was provided for simplification purposes that the compressor frequency remains constant (maximum) over the entire run time and was controlled with the throttle device. From the graphical representation of the curves of the actual temperature T it is apparent that the regulation of the temperature of the bowl air is performed much more continuously according to the present invention and a lower end temperature can be used.

Besides the described advantages with respect to cooling power the samples can be kept at a particular temperature much more precisely which is very advantageous in particular for sensitive samples or problematic temperature influences.

Overall it is appreciated that the instant invention has the following advantages:

- more efficient utilization of the rotor cavity/evaporator of the centrifuge;
- more energy efficient function of the centrifuge;
- option to use a compressor with lower power or the compressor can be driven with a lower frequency for obtaining a predetermined cooling power which yields lower electrical power draw and thus energy savings;
- compressor starts less frequently which minimizes load peaks in the power grid and consumption;
- the compressor can be operated at an optimum operating point, more frequently at lower speed which reduces operating noise;
- the option of a controlled pressure equilibration between high pressure side and low pressure side reduces start up currents of the compressor. The EEV can be opened during standstill of the compressor in order to accelerate pressure balancing between high pressure side and low pressure side in order to reach higher control quality in the load range;
- more precise regulation of the temperature in the rotor bowl and thus of the sample temperature.

What is claimed is:

1. A laboratory centrifuge with a centrifuge bowl and a compressor cooling device, comprising:

a refrigeration cycle;

an evaporator;

a condenser; and a compressor, wherein the refrigeration cycle includes at least one continuously variable controllable throttle device upstream of the evaporator, wherein the at least one continuously variable controllable throttle device acts as an expansion element for regulating a refrigerant flow, wherein devices for determining an actual temperature of the centrifuge bowl of the centrifuge are provided, wherein the compressor is configured controllable with respect to its feed volume, wherein a nominal temperature of the centrifuge bowl is predetermined, wherein a tolerance range of +/−5K about the nominal temperature of the centrifuge bowl is predetermined, wherein the laboratory centrifuge is configured to adjust the at least one continuously variable controllable throttle device to a predetermined refrigerant flow upon startup of the compressor cooling device, and wherein the laboratory centrifuge is configured to lower the actual temperature in the centrifuge bowl into the tolerance range through the controllable compressor and to keep compressor power constant thereafter as on as the actual temperature of the centrifuge bowl is in the tolerance range, wherein the actual temperature of the centrifuge bowl is regulated exclusively by the at least one continuously variable controllable throttle device as long as the actual temperature of the centrifuge bowl is in the tolerance range, and wherein the controllable compressor and the at least one continuously variable controllable throttle device are controlled by at least one regulation device.

2. The laboratory centrifuge according to claim 1, wherein at least one device is provided for detecting a first temperature of the refrigerant upstream of the evaporator and a second temperature of the refrigerant downstream of the evaporator or the actual temperature of the centrifuge bowl.

3. The laboratory centrifuge according to claim 1, wherein the compressor is power controllable with respect to its feed volume or frequency controllable, or wherein a bypass is configured in the refrigeration cycle for bridging the evaporator, and wherein the bypass is configured regulatable through a second controllable throttle device.

4. The laboratory centrifuge according to claim 1, wherein regulation devices are provided which use at least one detected temperature from the group consisting of: the first temperature of the refrigerant upstream of the evaporator, the second temperature of the refrigerant downstream of the evaporator, and the actual temperature of the centrifuge bowl as an input value, and wherein the regulation devices control and regulate at least one of the elements from the group consisting of the at least one continuously variable Controllable throttle device, controllable bypass and the controllable compressor.

5. The laboratory centrifuge according to claim 1, wherein devices for determining a tendency of the actual temperature of the centrifuge bowl in a predetermined tendency period are provided, and wherein the laboratory centrifuge is configured to regulate the at least one continuously variable controllable throttle device up or down when the tendency of the of the actual temperature of the centrifuge bowl in the tendency period increases or decreases.

6. The laboratory centrifuge according to claim 1, wherein the at least one continuously variable controllable throttle device is configured as an electronic injection valve.

7. The laboratory centrifuge according to claim 1, wherein the laboratory centrifuge includes regulation capable of coarse regulation and fine regulation, wherein the regulation controls the compressor and the at least one continuously variable controllable throttle device, or only the compressor in a first coarse regulating step, and wherein a regulation through the at least one continuously variable controllable throttle device without regulating the compressor is performed in a second fine regulating step.

8. The centrifuge according to claim 1, wherein the regulation is configured so that the nominal temperature of the centrifuge bowl of the centrifuge is predeterminable and the actual temperature of the centrifuge bowl of the centrifuge is determinable, wherein the tolerance range about the nominal temperature is predeterminable which tolerance range is +/−5 K at the most, wherein the actual temperature of the centrifuge bowl is reducible through the compressor into the tolerance range upon start up of the compressor cooling device, and wherein the compressor power is maintained to be constant as long as the actual temperature of the centrifuge bowl is in the tolerance range and the actual temperature of the centrifuge bowl is regulatable through the at least one continuously variable controllable throttle device.

9. The centrifuge according to claim 8, wherein the regulation is configured to consider a tendency of the actual temperature of the centrifuge bowl, and wherein a tendency period of at least 10 s is adjustable.

10. A method for controlling and regulating the compressor cooling device of the laboratory centrifuge with the centrifuge bowl according to claim 1, comprising the steps:

using the at least one continuously variable controllable throttle device upstream of the evaporator for regulating the refrigerant flow in the refrigeration cycle of the compressor cooling device;

controlling the compressor with respect to its feed volume;

predetermining the nominal temperature of the centrifuge bowl;

determining the actual temperature of the centrifuge bowl of the centrifuge;

predetermining a tolerance range of +/−5K at the most about the nominal temperature of the centrifuge bowl;

adjusting the at least one continuously variable controllable throttle device to the predetermined refrigerant flow upon startup of the compressor cooling device;

lowering the actual temperature of the centrifuge bowl into the tolerance range through the controllable compressor; and thereafter keeping the compressor power constant as long as the actual temperature of the centrifuge bowl is in the tolerance range and the actual temperature of the centrifuge bowl is regulated by the controllable throttle device.

11. The method according to claim 10, wherein a tendency of the actual temperature of the centrifuge bowl is determined in a predetermined tendency period, wherein the tendency period is at least 10 s, or wherein the at least one continuously variable controllable throttle device is regulated up or down when the tendency of the actual temperature of the centrifuge bowl increases or decreases during the tendency period.

12. The method according to claim 11, wherein the tolerance range about the nominal temperature of the centrifuge bowl is +/−3 K at the most, and wherein the actual temperature of the centrifuge bowl is regulated by the at least one continuously variable controllable throttle device when the actual temperature of the centrifuge bowl is within the tolerance range, and wherein the controllable compressor is used and the compressor is controlled when the actual temperature of the centrifuge bowl exceeds or undercuts the tolerance range so that the actual temperature of the centrifuge bowl returns into the tolerance range.

13. The method according to claim 11, wherein the compressor is regulated over a first time period until the actual temperature of the centrifuge bowl is within the tolerance range for a second time period, which is 60 times the tendency period at the most, and wherein the compressor power is kept constant thereafter as long as the actual temperature of the centrifuge bowl is in the tolerance range and the actual temperature of the centrifuge bowl is controlled by the at least one continuously variable controllable throttle device.

14. The method according to claim 10, wherein a temperature of the refrigerant in the refrigeration cycle is determined a) upstream of the evaporator, b) downstream of the evaporator, and wherein the at least one continuously variable controllable throttle device is regulated so that a difference of the temperature of the refrigerant in the refrigeration cycle upstream of the evaporator and the temperature of the refrigerant in the refrigeration cycle downstream of the evaporator is between 0 K and 5 K.

15. The method according to claim 10, wherein the temperature of the refrigerant in the refrigeration cycle is determined upstream of the evaporator and when undercutting a predetermined minimum temperature the predetermined minimum temperature is at least reached again through one of the subsequent measures:

lowering the feed volume of the compressor;

opening and regulating a bypass which circumvents the condenser in the refrigeration cycle; and regulating the controllable throttle device for increasing the refrigerant flow in the refrigeration cycle of the compressor cooling device.

16. The method according to claim 10, wherein an early cut off value is provided above the nominal temperature of the centrifuge bowl or above the tolerance range, and wherein the compressor is regulated down or switched off or the at least one continuously variable controllable throttle device is actuated in a closing direction when reaching the early cutoff value with the actual temperature of the centrifuge bowl.

17. The method according to claim 10, wherein an electronic injection valve is used for the at least one continuously variable controllable throttle device.

18. The laboratory centrifuge according to claim 1, wherein at least one device is provided for detecting a first temperature of the refrigerant upstream of the evaporator and a second temperature of the refrigerant downstream of the evaporator and the actual temperature of the centrifuge bowl.

19. The laboratory centrifuge according to claim 1, wherein the compressor is power controllable with respect to its feed volume or frequency controllable and wherein a bypass is configured in the refrigeration cycle for bridging the evaporator, and wherein the bypass is configured regulatable through a second controllable throttle device.

20. The method according to claim 10, wherein a tendency of the actual temperature of the centrifuge bowl is determined in a predetermined tendency period, wherein the tendency period is at least 10 s, and wherein the at least one continuously variable controllable throttle device is regulated up or down when the tendency of the actual temperature of the centrifuge bowl increases or decreases during the tendency period.

* * * * *